United States Patent [19]

Chen et al.

[11] Patent Number: 4,856,114

[45] Date of Patent: Aug. 15, 1989

[54] SEAMAN STYLE PRESET NECKTIE

[76] Inventors: Jiann-Jong Chen; Ching-Hwa Chen, both of 21, Alley 21, Lane 244, Sec. 5, Yen-Ping North Road, Taipei, Taiwan

[21] Appl. No.: 224,608

[22] Filed: Jul. 27, 1988

[51] Int. Cl.[4] ..... A41D 25/04; A41D 25/14

[52] U.S. Cl. ..... 2/149; 2/150; 2/152 R

[58] Field of Search ..... 2/149, 150, 152 R, 152 A, 2/153, 148

[56] References Cited

U.S. PATENT DOCUMENTS

| | | | |
|---|---|---|---|
| 2,247,184 | 6/1941 | Burfening | 2/150 |
| 2,294,508 | 9/1942 | Minor | 2/150 |
| 3,127,618 | 4/1964 | Roach | 2/150 |
| 3,284,807 | 11/1966 | Espino | 2/153 |
| 3,363,264 | 1/1988 | Mathison | 2/150 |
| 3,453,697 | 7/1969 | Berzeny, Sr. | 2/150 X |
| 4,000,523 | 1/1977 | Woods | 2/150 |
| 4,024,585 | 5/1977 | Girdler | 2/153 |
| 4,337,539 | 7/1982 | Najarian | 2/153 |
| 4,513,453 | 4/1985 | Chen et al. | 2/150 |
| 4,656,672 | 4/1987 | Lande | 2/150 |
| 4,710,982 | 12/1987 | Lande | 2/150 |
| 4,771,481 | 9/1988 | Gasser | 2/157 R X |

FOREIGN PATENT DOCUMENTS

| | | | |
|---|---|---|---|
| 352640 | 4/1961 | Sweden | 2/150 |

*Primary Examiner*—H. Hampton Hunter

*Attorney, Agent, or Firm*—Wegner & Bretschneider

[57] ABSTRACT

The present invention provides a seaman style preset necktie characterized mainly in that the portions of the necktie below the tie knot are bifurated into two branches, there are no inner and outer ties as those with conventional neckties, and that the tie knot is suspended before the wearer's chest instead of being tied adjacent to the neck opening. In the present invention, both ends of the necktie are provided with zippers on the same side and the tie knot is provided with a pair of zipper sliders which are disposed invertedly relative to each other, the upper slider causing the portions of the necktie body to be gathered while the lower one causing them to be separated again, such that the position of the tie knot can be adjusted by sliding the sliders. After proper adjustment, by means of the fastening means on the ends of the outer cover of the tie knot, it is only necessary to fold and press said outer cover of the tie knot to be securely set.

2 Claims, 2 Drawing Sheets

SEAMAN STYLE PRESET NECKTIE

DESCRIPTION OF PRIOR ART

In general, a conventional necktie can be divided into an inner tie and an outer tie with the former one concealed behind the latter one so that only the broader outer tie can be seen. In contrary, there are no inner and outer ties in the seaman style neckties. The portions of the tie below the tie knot are separated sidewardly and the knot is suspended before the wearer's chest instead of being tied adjacent to the neck opening. With conventional seaman style neckties, a particular method similar to that for tying a bow has been used to tie both ends of the necktie (or a piece of triangular cloth) into a tie knot with bifurated ends depending in front of the wearer's chest. The above-mentioned seaman style neckties have the following disadvantages:

(1) It is troublesome and time-consuming to tie the knot, which is inconsistent with the requirements for swiftness in the seamen's daily activities; and (2) It is difficult to control the position where the knot is tied and even more difficult to have the knots tied at a uniform position so that when a group of necktie-wearing seamen gather into a formation, the positions of the knots will be at different levels and unable to appear along a straight line, which is rather unsightly.

SUMMARY OF THE INVENTION

The necktie of the present invention is intended to overcome the above-mentioned disadvantages. In the present invention, both ends of the necktie are provided with zippers of same color on the same side (or the zippers may be provided on the folding edge of the triangular cloth) and the collector of the tie knot is provided with a pair of zipper sliders disposed invertedly with respect to each other, the zippers on the one side of the necktie being each inserted through the upper slider to become gathered and then through the inverted lower slider to become separated again, such that the necktie can be slid up and down within the sliders, thereby to adjust the position of the tie knot. After proper adjustment of the tie knot, the outer cover secured to the collector is folded and pressed inwardly so that the tie knot can be securely set. Therefore, the seaman style necktie of the present invention is very convenient to use.

BRIEF DESCRIPTION OF THE DRAWINGS

The structure of the present invention will now be described with reference to the accompanying drawings in which.

DETAILED DESCRIPTION OF THE PREFERRED EMBODIMENT

Figure 1:
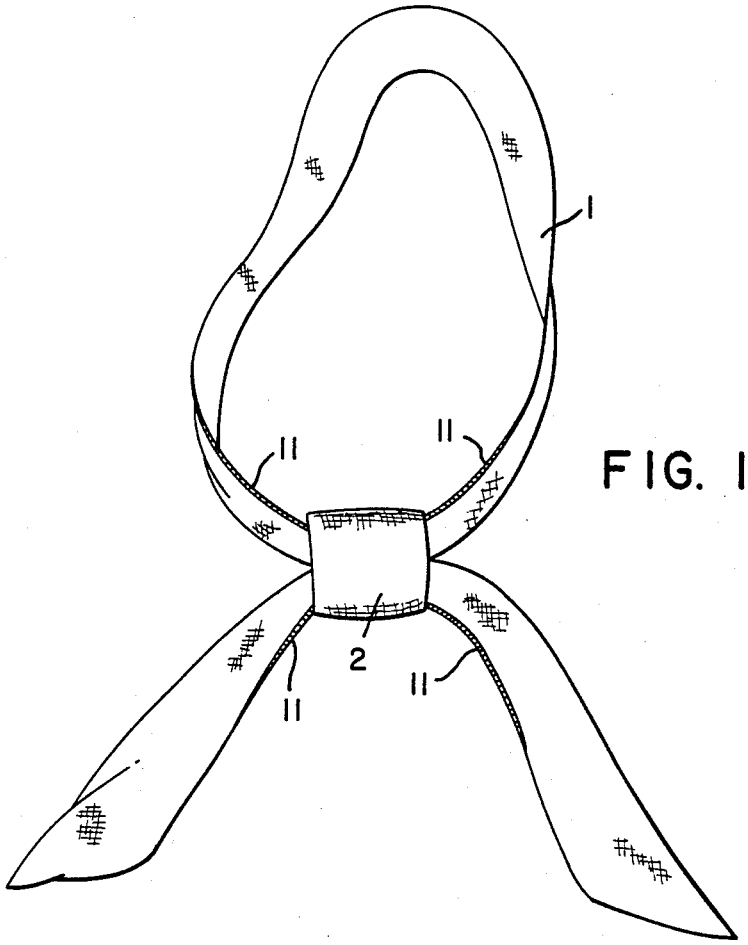
FIG. 1 is a perspective view of a preferred embodiment of the present invention.

FIG. 1 shows a preferred embodiment of the present invention in which the necktie body (1) is a broad strip of cloth, both ends thereof being provided with zippers (11) along the edge of the same side, said zippers passing through a pair of zipper sliders (the structure of which will be described hereinafter) disposed oppositely on the upper and lower ends of a tie knot (2) to gather the portions of the tie body (1) and then to cause them to be separated again to become the shape of a seaman style necktie as shown in the drawing. The gathering and separation of the tie body (1) are completely under the action of the zippers (11) and the zipper sliders (which are wrapped in the tie knot (2) and cannot be seen in FIG. 1) such that the position of the tie knot (2) can be adjusted up and down freely.

Alternatively, a folded triangular cloth can be used as the tie body (1) of the present invention as long as the zippers are provided along the folding edge.

Figure 2:
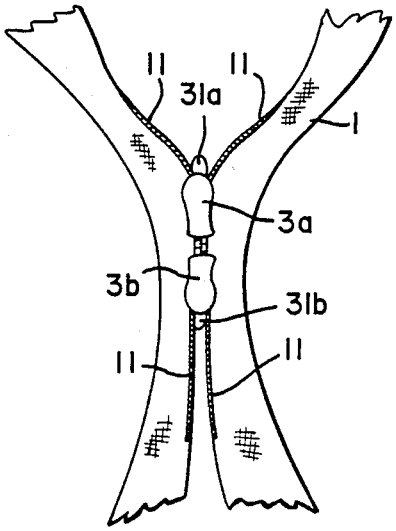
FIG. 2 is a view showing the upper and lower zipper sliders through which the zippers disposed along one side of the necktie body are inserted.

In installation, the zippers (11) on the tie body (1) are firstly inserted through the upper slider (3*a*) to gather the portions of the tie body (1), then through the inverted lower slider (3*b*) causing the ends of the tie body (1) to be separated to become the configuration as shown in FIG. 2.

Figure 3:
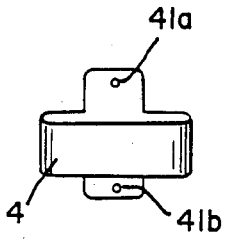
FIG. 3 is a view showing the structure of the collector of the tie knot.

In FIG. 3, there is shown a collector (4) made of a metal plate. To install, the ends of the tie body (1) which have been inserted through the upper and lower sliders (3*a*, 3*b*) as shown in FIG. 2, together with the sliders (3*a*, 3*b*), are inserted into said collector (4) to be secured to a leather fitting plate (5, please refer to FIG. 4) by threading a pair of rivets through the pull button holes (31*a*, 31*b*) on the sliders (3*a*, 3*b*) and the mounting holes (41*a*, 41*b*) on the collector (4), such that they are arranged into the configuration as shown in FIG. 4.

Figure 4:
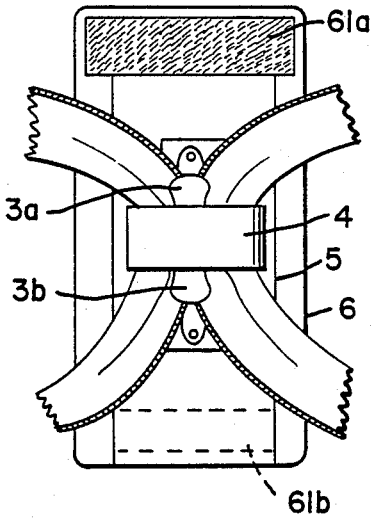
FIG. 4 is a view showing the manner in which the sliders, the fitting plate, and the outer cover of the tie knot are arranged.

In FIG. 4, there is shown the configuration of the installed fitting plate (5) which has been sewn to the outer cover (6) of the tie knot, said outer cover being made of cloth of the same material as the tie body (1). Moreover, the outer cover (6) of the tie knot is provided with fastening means (61*a*, 61*b*) at corresponding positions on the front and back sides on the upper and lower ends, respectively. Such fastening means, commercially known as "VELCRO", and often used on shoe uppers, can be fastened very easily. In particular, the dragging force in the horizontal direction is so great that the fastening means will not come apart unless they are first pulled off in the vertical direction. After being pressed and fastened, the tie knot of the present invention will subject to tension only in the horizontal direction so that it is impossible for the tie knot to pop open.

As shown in FIGS. 1 to 4, the installation procedure has been completed and now the position where the portions of the tie body (1) are gathered can be slid up and down freely. After proper adjustment of the position, the lower end of the outer cover of the tie knot is folded outwardly and upwardly (as viewed in the drawing, since the back side of the tie knot is facing the page of the drawing, the lower end is folded inwardly and upwardly during actual use) to become the shape as shown in FIG. 5.

Figure 5:
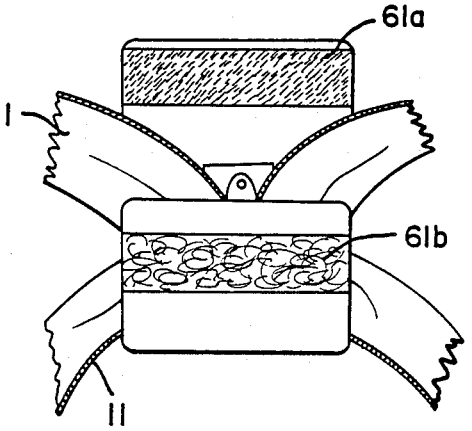
FIG. 5 is a view showing the manner in which the upper and lower ends of the outer cover are fastened to become a tie knot.
Figure 6:
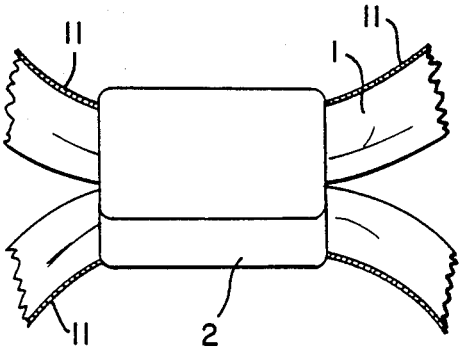
FIG. 6 is a view showing the configuration of a completed tie knot.

Then the fastening means (61*a*, 61*b*) are fastened by folding the upper end of the outer cover of the tie knot shown in FIG. 5 downwardly, thus to complete the finished tie knot (2) as shown in FIG. 6 with the front face like the tie knot shown in FIG. 1. When completed, the tie body (1) is substantially bent due to the wrapping and pressing by the outer cover of the tie knot so that the position of the tie knot will never move unless the outer cover of the tie knot is unfolded. Similarly, if adjustment of the position of the tie knot is desired, all that is necessary is to have the outer cover of the tie knot released. Therefore, the seaman style preset necktie of the present invention is very convenient to use.

We claim:

1. A seaman style preset necktie comprising:

a tie body made of a strip of cloth, both ends thereof being provided with zippers of same color along the edges on the same side;

a tie collector, a normally oriented zipper slider being fixed on the upper portion of said collector and another inverted zipper slider being fixed on the lower portion thereof;

a leather fitting plate securely sewn on the outer cover of the tie knot, said fitting plate being securely connected to said collector and said zipper sliders by means of rivets;

an outer cover for the tie knot, the front side of the upper end of said outer cover and the back side of the lower end thereof being each provided with fastening strip means which will be fastened one to the other when said outer cover is folded; wherein the zippers on said tie body are firstly inserted through said slider provided on the upper portion of said collector to gather the portions of said tie body, then through said inverted slider provided on the lower portion of said collector causing the ends of said tie body to be separated, and then by bending the lower end of said outer cover of the tie knot upwardly and outwardly and folding the upper end of said outer cover of the tie knot downwardly so that said fastening means can be fastened.

2. The necktie as set forth in claim 1 wherein said collector is provided with a mounting hole on both the upper and the lower portions thereof, said rivets being threaded through the pull button holes, then the mounting holes, and finally the leather fitting plate, such that said collector, said zipper sliders, and said fitting plate are securely connected together.

* * * * *